United States Patent [19]

Puhich

[11] 4,195,292

[45] Mar. 25, 1980

[54] PROGRAMMABLE BOBBIN THREAD DETECTOR

[76] Inventor: Joseph M. Puhich, 3655 Prune Ridge Ave., Apt. 169, Santa Clara, Calif. 95051

[21] Appl. No.: 884,994

[22] Filed: Mar. 9, 1978

[51] Int. Cl.[2] ..... B65H 63/02; G08B 29/00

[52] U.S. Cl. ..... 340/677; 112/278; 235/92 CM; 235/92 PE; 242/57

[58] Field of Search ..... 340/673, 675, 677, 384 R; 112/273, 278; 242/49, 57; 235/92 CM, 92 PE, 92 DN; 328/48; 307/225

[56] References Cited

U.S. PATENT DOCUMENTS

| | | | |
|---|---|---|---|
| 2,326,852 | 8/1943 | Haas | 340/677 |
| 2,420,275 | 5/1947 | Winberg | 340/677 |
| 2,910,555 | 10/1959 | Tunstall | 340/675 X |
| 3,038,120 | 6/1962 | Bernstein et al. | 340/384 R |
| 3,161,365 | 12/1964 | Johnson et al. | 242/57 |
| 3,188,572 | 1/1965 | Bell | 328/48 X |
| 3,550,117 | 12/1970 | Smith | 340/384 R |
| 3,577,084 | 5/1971 | Atcherson et al. | 328/48 X |
| 3,599,586 | 8/1971 | Newman | 340/675 X |
| 3,843,883 | 10/1974 | DeVita et al. | 340/677 X |
| 3,918,036 | 11/1975 | Jacobson | 340/677 |
| 3,928,752 | 12/1975 | Darwin | 235/92 PE X |
| 4,040,367 | 8/1977 | Crawford et al. | 112/273 |
| 4,066,876 | 1/1978 | Shaw et al. | 235/92 CM |
| 4,068,462 | 1/1978 | Duff et al. | 328/48 X |

*Primary Examiner*—John W. Caldwell, Sr.
*Assistant Examiner*—Joseph E. Nowicki
*Attorney, Agent, or Firm*—Harry M. Weiss

[57] ABSTRACT

A programmable bobbin thread detector which generates a signal when the amount of thread remaining on a bobbin is sufficient to complete only one more seam. At the beginning of each operation, the operator sews a complete seam with a full bobbin and the number of bobbin revolutions are stored in a first counter. The operator then fills a new bobbin. Each turn of the bobbin during the winding operation is detected and increments a second counter until its contents correspond to the total number of thread revolutions on the new bobbin minus the number of revolutions necessary to complete one seam. The complement of this number is loaded into a third counter. During subsequent sewing operations using a new bobbin, a third counter is incremented with each revolution of the bobbin, and an alarm is generated when the third counter reaches a predetermined state.

22 Claims, 7 Drawing Figures

PROGRAMMABLE BOBBIN THREAD DETECTOR

BACKGROUND OF THE INVENTION

1. Field of the Invention

This invention relates generally to detection systems or circuits, and more particularly, to an apparatus including an integrated digital counting circuit for measuring the amount of thread remaining on a sewing machine bobbin and generating signal when the amount of remaining thread is equivalent to that which is necessary to complete only one more seam.

2. Description of the Prior Art

As is well known, commercial sewing machines require first and second sources of thread. The first is generally mounted on the upper part of the machine and is threaded to engage the hook. This source of thread is visible to the operator. The second source of thread, contained in a bobbin, is housed beneath the slide plate or sewing surface for engaging the hook on the underside of the garment being sewn. The bobbin is inserted into a bobbin case which is in turn housed in a bobbin basket. Since the bobbin basket is mounted in the hook apparatus below the sewing surface, the amount of thread remaining on the bobbin is not readily apparent to the sewing machine operator. Thus, each time the sewing machine operator begins a new seam, he runs the risk of running out of bobbin thread before the seam is completed.

To require the operator to perform the manual manipulations necessary to visibly check the amount of remaining bobbin thread would be at least troublesome, and in a commercial setting, economically prohibitive. At the same time, however, to ignore the amount of remaining bobbin thread would require the operator to either rip out an incomplete seam or to pass on the garment bearing an incomplete seam as a "second" or "irregular."

Thus, while modern sewing machine technology enables operators to rapidly sew many seams, the operator has not yet been supplied with a convenient method or apparatus for monitoring the amount of thread remaining on the bobbin.

SUMMARY OF THE INVENTION

It is an object of the present invention to provide a method and apparatus for monitoring the amount of thread remaining on a sewing machine bobbin.

It is a further object of the invention to provide a method and apparatus for generating a signal when the amount of thread remaining on the bobbin is substantially equal to the amount necessary to complete only one more seam.

Accordingly, it is a feature of the invention to provide a method and apparatus for generating a signal when the complement of a first number stored therein has been incremented to a second predetermined number stored therein.

It is still a further object of the invention that the apparatus be programmable to seams of various lengths and independent of variables such as thread density and stretchability.

It is yet another object of the invention that the major portion of said apparatus be digital and monolithically integrable.

Finally, it is a broad object of the invention to provide a method and apparatus for determining when a length of material wound on a rotating housing is as least as long as a predetermined length.

According to a broad aspect of the invention, there is disclosed an apparatus for indicating that the amount of thread remaining on a sewing machine bobbin is at least as long as a predetermined seam length which comprises means for monitoring the amount of thread remaining on said bobbin, and means for generating a signal when the length of thread remaining on said bobbin is sufficient to complete only one more seam of said predetermined length.

According to another aspect of the invention, there is disclosed a method for determining when the amount of thread remaining on a sewing machine bobbin is as least as long as a predetermined seam length which comprises monitoring the amount of thread remaining on said bobbin, and generating a signal when the length of thread remaining is sufficient to complete only one more seam of said predetermined length.

According to a still further aspect of the invention, there is disclosed a circuit comprising first means for counting from a first number which is less than zero to a more positive number, and second counting means coupled to said first means for counting from a second number less than zero, said second number substantially equal in absolute value to said more positive number.

According to yet another aspect of the invention there is disclosed a method and apparatus for indicating when a length of material wound on a housing is as least as long as a predetermined length comprising monitoring the amount of material remaining on said housing, and generating a signal when the length of material remaining is at least as long as said predetermined length.

The foregoing and other objects, features and advantages of the invention will be apparent from the following detailed description of preferred embodiments taken in conjunction with the accompanying drawings, in which:

DESCRIPTION OF THE PREFERRED EMBODIMENT

Figure 1:
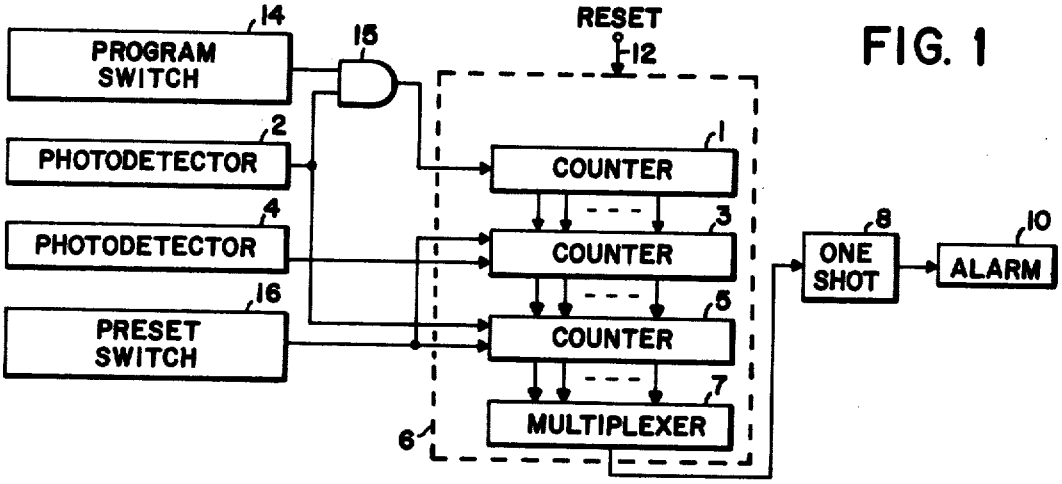
FIG. 1 is a functional block diagram of the inventive bobbin thread monitoring system.

FIG. 1 is a functional block diagram of the inventive bobbin thread monitoring system, and includes two photodetectors 2 and 4, a detection circuit 6, a one-shot 8 and an alarm 10. The arrangement shown must be programmed prior to sewing each sequence of seams. This is accomplished by first resetting detection circuit 6 via reset line 12 and then activating program switch 14. Both the reset and program switch functions may be accomplished using simple switch arrangements, e.g. pushbutton or toggle switches.

The operator next inserts a full bobbin into the bobbin case and sews one complete seam of the type which will be repeated during subsequent sewing operations.

Photodetector 2 detects revolutions of the bobbin while this first seam is being sewn and generates an output signal for each revolution. Since the program switch 14 has been set, the signals from photodetector 2 are passed through and function 15 to a first counter 1 in detection circuit 6. As a result, counter 1 counts the total number of bobbin revolutions which occurred during the sewing of the first seam. When the seam has been completed, program switch 14 is disabled and the bobbin is removed. Thus, counter 1 contains a number representative of the total number of bobbin revolutions which must be available to complete one seam.

Next, the operator activates preset switch 16 which allows the complement of the number stored in counter 1 to be loaded into the third through seventh most significant bits (MSBs) of eleven bit counter 3.

The operator then winds up a new bobbin using the conventional bobbin winding apparatus on the sewing machine. Photodetector 4 is mounted so as to detect each revolution of the bobbin during the winding process. A signal generated by photodetector 4 for each bobbin revolution is applied to the input of counter 3 for incrementing counter 3. Thus, although counter 3 originally contained a negative number as a result of its pre-programming with the complement of the contents of counter 1, counter 3 will be incremented to a positive number corresponding to the total number of turns of thread in the newly wound bobbin minus four times the number of turns in the programmed length plus one i.e. Total−4 (PL+1) where Total equals the number of turns in the newly wound bobbin and PL equals the number of bobbin revolutions which occurred during pre-programming using a full bobbin.

The preset switch likewise enables the loading of the complement of the contents of counter 3 into counter 5. Thus, when counter 5 is first loaded, it contains a negative number.

The operator now inserts the newly wound bobbin into the bobbin case and basket and begins sewing. As the operator sews, photodetector 2 generates a signal for each revolution of the bobbin. These signals are applied to counter 5 causing it to increment by one for each signal received. Many seams can be sewn using the contents of a single bobbin; however, when counter 5 has been incremented to its maximum state, i.e. 11111111111, multiplexer 7 generates a signal which triggers one-shot 8. The output of one-shot 8 in turn activates an alarm 10 whereby the operator is made aware of the fact that only one more seam can be completed. If the operator is in the middle of a seam when the alarm is generated, he can complete that seam and must then fill a new bobbin in accordance with the procedure set forth above.

In order to assure proper detection of the bobbin revolutions, both during winding and sewing, the rotating bobbin assembly may include alternate regions of white and black paint or reflective tape of the type manufactured by 3M Company.

While the above description of the apparatus shown in FIG. 1 has been rather general in nature, a more detailed description of the circuits and operation involved is given hereinbelow in conjunction with FIGS. 2, 3, 4*a*, 4*b* and 5.

Figure 2:
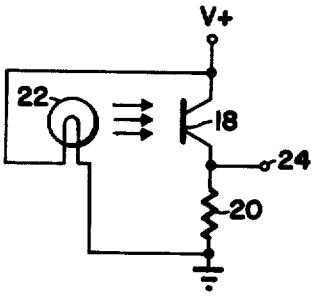
FIG. 2 is a schematic diagram of the photodetectors used in the system shown in FIG. 1.

FIG. 2 is a schematic diagram of a photodetector circuit of a type which may be used in the apparatus of FIG. 1. A phototransistor 18 is coupled across a source of supply voltage Vt and ground via resistor 20. A source of light for triggering phototransistor 18 is provided by lamp 22. As a result of light generated by lamp 22 being reflected from the bobbin and inpinging on phototransistor 18, the transistor conducts resulting in an output signal appearing at terminal 24. A phototransistor suitable for use in the circuit of FIG. 2 is commercially available from Fairchild and bears part number FPT400. Likewise, the light source 22 in FIG. 2 may be of a type commercially available from Oshino or Chicago Minature Light and bears a part number CM680. Since photodetectors of the type shown in FIG. 2 are well known, further discussion is not deemed necessary.

Figure 3:
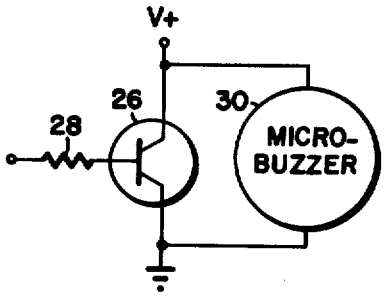
FIG. 3 is a partial schematic diagram of the alarm of FIG. 1.

The alarm circuit 10 in FIG. 1 is shown in more detail in FIG. 3. A power transistor 26, for example a 2N2222 NPN power transistor commercially available from Motorola Semiconductor Inc., has its base coupled to the output of one-shot 8 via resistor 28. The collector of transistor 26 is coupled to a source of supply voltage Vt and the emitter is coupled to ground. A microbuzzer 30 is coupled across the collector-emitter path of power transistor 26. When one-shot 8 generates an output, typically for a period of 3 seconds, the microbuzzer 30 is enabled providing an audible alarm to the sewing machine operator. A suitable microbuzzer for use in the circuit of FIG. 3 is commercially available from Citizen America Corp. and bears part number SMB-06. Series resistance 28 in the order of 1 KΩ allows an intense signal to be generated which may be heard over the roar of operating sewing machines. Notwithstanding the above, it should be clear that other types of alarm systems could be employed, e.g. a visual alarm system.

Figure 4A:
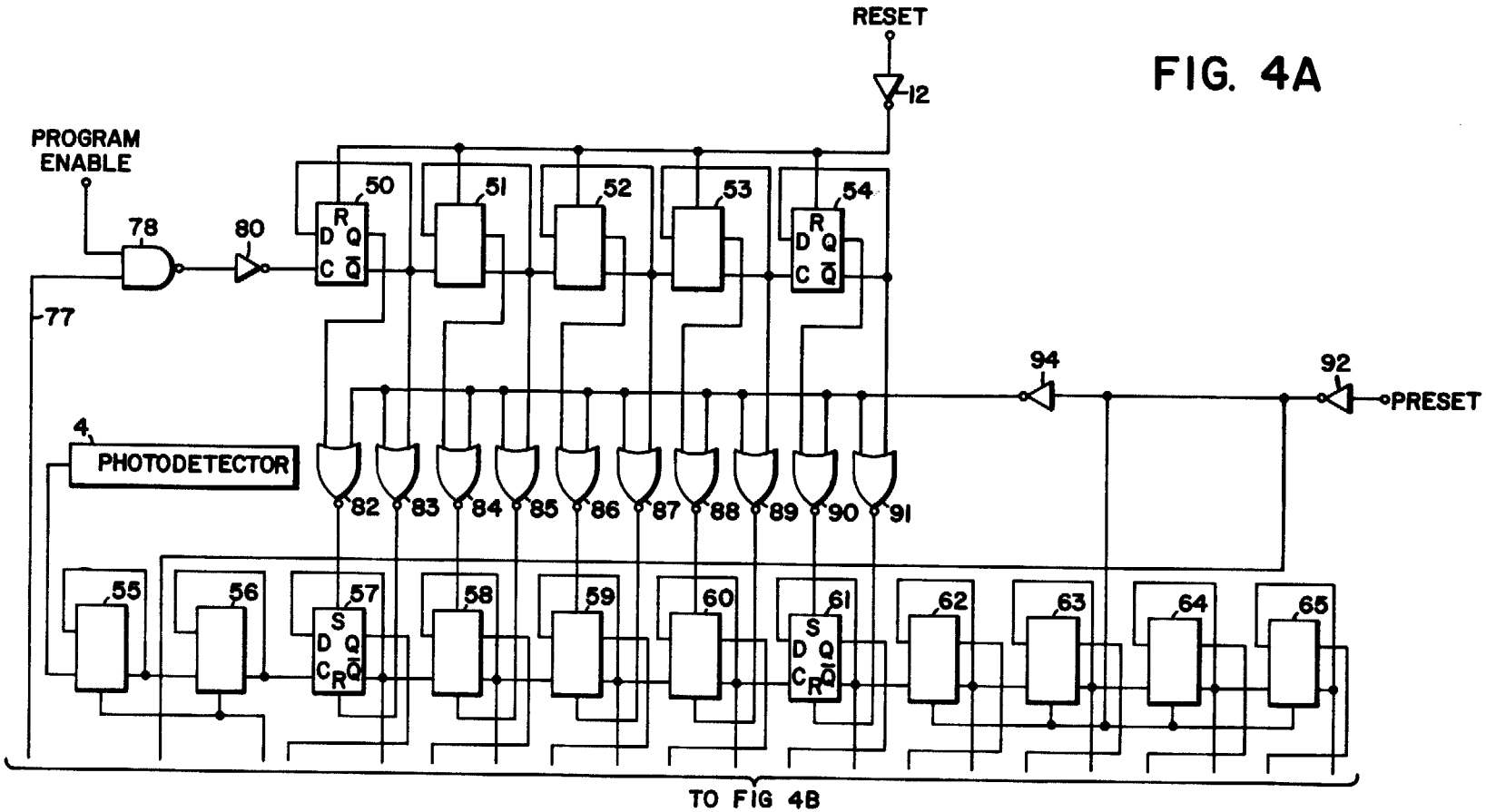
FIGS. 4*a* and 4*b* are detailed logic diagrams of the detector shown in FIG. 1.
Figure 4B:
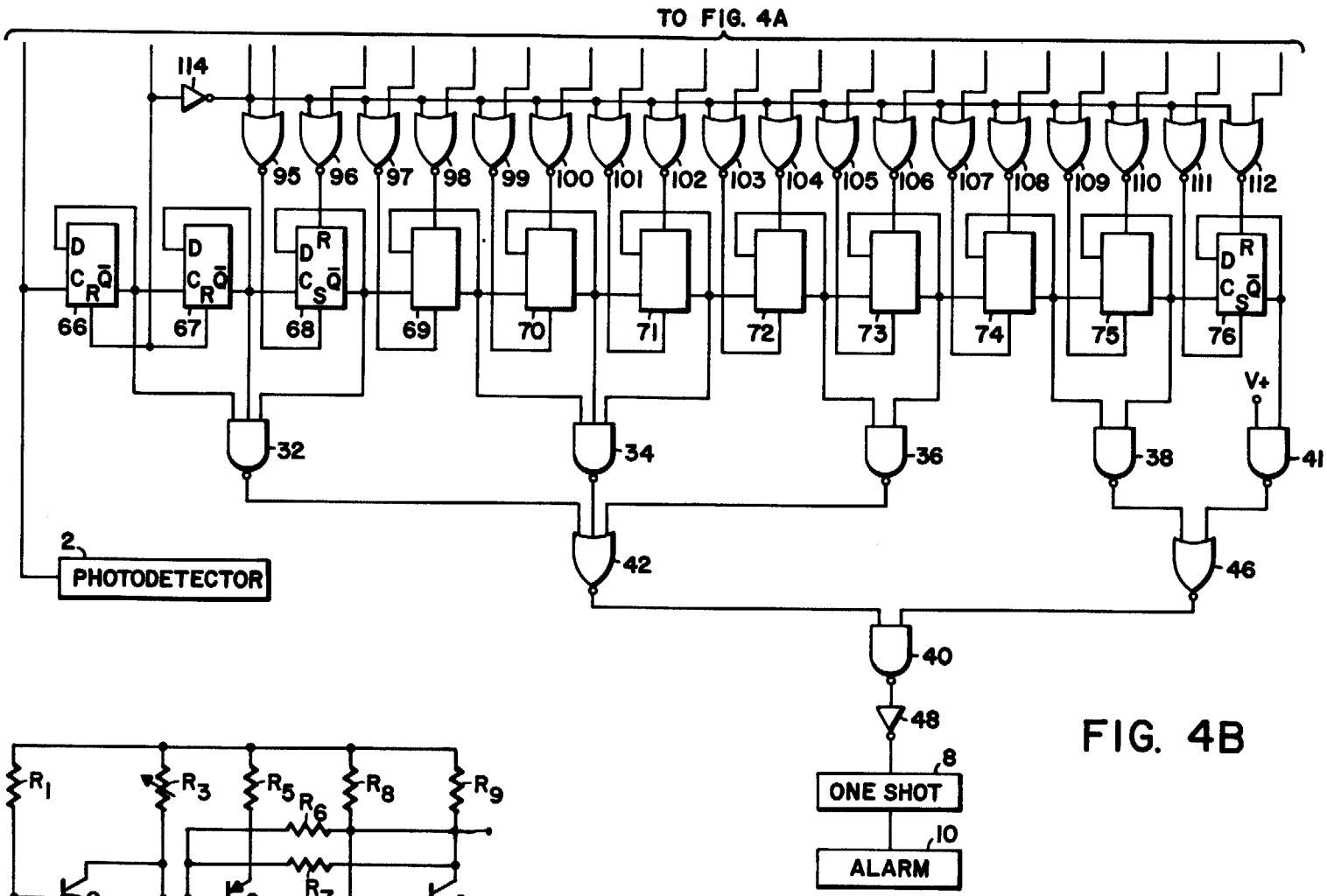

FIGS. 4*a* and 4*b* represent a detailed logic diagram of the detection circuit 6 of FIG. 1. The circuit comprises four basic sections. The first is a five bit binary counter comprising flip-flops 50–54. Two eleven bit binary counters 55–65 and 66–76 respectively comprise the second and third sections. The fourth section is a multiplexer including NAND gates 32, 34, 36, 38, 40 and 41, NOR gates 42 and 46 and inverter 48. ¶As stated previously, before beginning each operation, it is necessary that the operator reset the detection circuit. This is accomplished by means of a reset signal applied to flip-flops 50–54 via line 12. A program enable signal applied to NAND gate 70 from program switch 14 (FIG. 1) enables signals from photodetector 2 to be applied to the first bit of five bit counter 50–54 via line 77 and NAND gate 78. During the programming stage, counter 50–54 counts the number of bobbin revolutions necessary to complete one seam. Counter 50–54 has a count capacity of 32 states, and this translates to approximately two yards of thread.

After the programmed length has been measured and the program switch disabled, the operator activates present switch 16 (FIG. 1) which causes the complement of the number stored in counter 50–54 to be loaded into the third through seventh MSBs of couner 55–65 i.e. bits 57–61. This is accomplished by the enabling of NOR gates 82–91 each of which has one input coupled to the preset signal via inverters 92 and 94. The other input of each of the NOR gates 82–91 is coupled to an output of a corresponding one of flip-flops 50–54. For example, NOR gate 82 has an input coupled to the Q output of flip-flop 50, and NOR gate 83 has an input coupled to the Q output of flip-flop 50. Similarly, NOR gates 84 and 85 are coupled to the outputs of flip-flop 51, NOR gates 86 and 87 are coupled to the outputs of flip-flop 52, etc.

After the programming stage, the operator begins winding a new bobbin using the existing sewing machine bobbin winding apparatus. Each time the bobbin revolves during the winding process, a signal is generated by photodetector 4 and applied to the first bit of the first eleven bit counter 55–65. This counter has a capacity of 2048 states. This is sufficient to allow any bobbin to be completely filled by size 80, polyester core, cotton covered thread. The largest bobbins accumulate approximately 1800 turns of thread during the winding process.

After winding, the first eleven bit counter 55–65 which originally contained a negative number as a result of being loaded with the complement of the contents of the first five bit counter now contains some positive number corresponding to the total number of revolutions which occurred during winding minus four times one more than the number of revolutions which occurred during the sewing of the programmed seam, i.e. Total $-4\times(PL+1)$ where PL is the number of bobbin revolutions necessary to sew the programmed seam with a full bobbin.

The outputs of the third through eleventh MSBs of the first eleven bit counter 55–65 are coupled to the inputs of the third through eleventh MSBs of a second eleven bit counter 66–76 via a plurality of NOR gates 95–112 which, like NOR gates 82–91, are enabled by the preset signal, only in this case via inverters 92 and 114. It should be clear that it is not necessary to couple the first and second bits of the first eleven bit counter to the first and second bits of the second eleven bit counter since as a result of the counting up operation during the bobbin winding process, the first eleven bit counter contains a number equal to the total number of bobbin revolutions during winding minus four more than four times the programmed length. Thus, if a count of four is lost during transfer from the first to the second eleven bit counter, the loss represents a move towards accuracy. If there is no loss as a result of the first and second bits of the first eleven bit counter containing zeros, the resulting error is not significant.

Now that the second eleven bit counter 66–76 contains approximately the complement of the number stored in the first eleven bit counter, the operator inserts the newly wound bobbin and begins sewing. With each revolution of the bobbin, a signal is generated by photodetector 2 which is coupled to the input of the second eleven bit counter. Each such signal causes the contents of the second eleven bit counter to increment by one. As the number in the second eleven bit approaches zero, the amount of thread on the bobbin is decreasing.

The above referred to multiplexer comprises NAND gates 32, 34, 36, 38, 40 and 41, NOR gates 42 and 46 and inverter 48 which are arranged to detect a state corresponding to all 1's in counter 66–76. When this occurs, a signal is generated which triggers one-shot 8 as described above. This signal indicates that the amount of thread left on the bobbin corresponds to approximately four times the number of revolutions used when sewing the programmed seam plus one i.e. $4(PL+1)$.

It should be obvious, however, to the skilled practitioner that the multiplexer logic can be rearranged to generate a signal until the amount of thread equals $4(PL+1)$. This would be especially suitable in the case of a visual alarm wherein a light remains lit until the minimum amount of thread is detected and then is extinquished.

It may be questioned why an alarm is generated when the amount of thread left on the bobbin corresponds to approximately four times the number of bobbin revolutions it took to sew the programmed seam. This can be readily understood when one considers the fact that when the programmed seam was sewn, the bobbin was full and therefore each revolution of the bobbin corresponded to substantially more thread than is the case when the bobbin is nearly empty. A factor of four has been found to be a satisfactory multiplier. Thus, the operator is assured that he has sufficient thread left on the bobbin to complete the seam and is made aware of the fact that he must wind and insert a new bobbin before sewing another seam.

In some cases, photodetectors 2 and 4 may pick up stray signals. To correct for this, a dual-adjustable Shmitt trigger of a type commercially available from Motorola Semiconductor Inc. and bearing a part number 14583B may be inserted between the photodetectors and the detection circuit 6. The Shmitt trigger filters the output of the photodetectors to provide only clean signals representing major transitions to the detection circuit.

Figure 5:
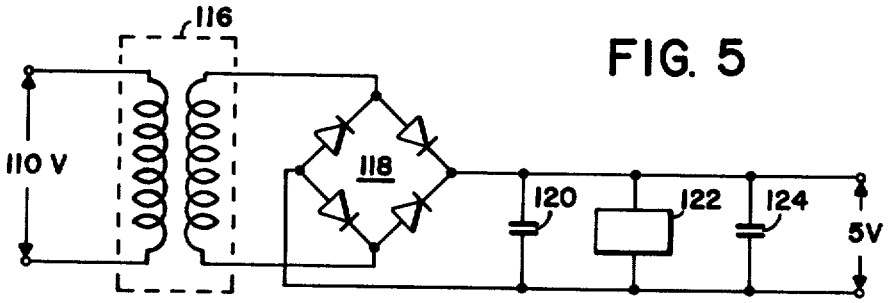
FIG. 5 is a schematic diagram of a power supply circuit suitable for energizing the bobbin thread monitoring system shown in FIG. 1.

A source of suppy suitable for powering the inventive bobbin thread detector is shown in FIG. 5. Line voltage (110 volts a.c.) is applied to a 6.3 volts a.c. transformer 116. The output of the transformer is applied to a full wave rectifier 118 comprising four one ampere diodes. The rectified signal is applied to a 1000 uf capacitor 120, a 5 volt, 1 ampere regulator 122 and a 100 uf capacitor 124. The capacitors provide a clean 5 volt signal at the output terminal for application to the remainder of the system.

If it should become necessary, a latch circuit may be employed to compensate for noise caused by jitter of the bobbin case, reflections from the bobbin case and transitions from white to black regions on the rotating bobbin assembly.

Figure 6:
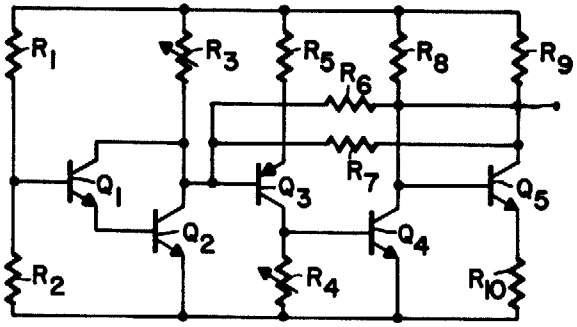
FIG. 6 is a schematic diagram of a latch circuit for use in the monitoring system shown in FIG. 1.

FIG. 6 illustrates a latch circuit which will both filter and amplify the optical signals. A voltage divider comprising resistors $R_1$(4.7 meg$\Omega$) and $R_2$(1.0 meg$\Omega$) is employed to bias the base of the photocell. The photocell drives PNP transistor Q3 which has a collector coupled to adjustable resistor $R_4$(3K$\Omega$), an emitter coupled to $R_5$(22K$\Omega$) and a base coupled to the collector of Q2. The emitter of Q3 follows the collector of Q2. The collector of Q3 turns on Q4 which feeds back to the base of Q3 via $R_6$(2K$\Omega$). This controls the pull-down of the latch. Transistor Q5 which feeds back to the base of Q3 via $R_7$(5K$\Omega$) drives the latch pull-up. The pull-up/pull-down results in a noise immunity of about 1 volt.

While the above description of the invention has been given with respect to specific embodiments, it should be clear that the invention is applicable to any situation where the amount of material wound on a housing is to be monitored, e.g. fishing line reels, cable laying apparatus, etc.

The invention is particularly suitable for use with wiring apparatus, e.g. wiring guns of the type used to wire back-panel or printed circuit board pins of various types of electronic equipment. Wiring guns of this type require a source of wire which may be mounted on a rotating spool and a source of clips which engage the wire and fasten it to the pins.

Generally, an operator is required to make a wire connection from a first designated pin to a second designated pin. It is therefore possible that an operator might fasten the end of the wire to the first designated pin and thereafter realize that there is an insufficient length of wire remaining on the spool to reach the second designated pin. The operator must then manually remove the wire and clip from the pin; a task which is not only time consuming, but one which could easily result in damage to other wires positioned near the first designated pin and/or to the pin itself.

The inventive detection system could be programmed to generate an alarm when the amount of thread remaining on the spool is at least as long as a predetermined minimum length thus eliminating the problem described above.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An apparatus for indicating that the length of thread remaining on a sewing machine bobbin in the form of a number of thread revolutions, each one of which corresponds to a bobbin revolution, is at least as long as a predetermined seam length, comprising:

means for monitoring the number of thread revolutions remaining on said bobbin, said means for monitoring comprising:

first means for counting the number of bobbin revolutions occurring when sewing a seam of said predetermined length;

second means for counting, coupled to said first means and preset with the complement of the contents of said first means, the number of thread revolutions in a full bobbin; and third means, coupled to said second means and preset with the complement of the contents of said second means, for counting each bobbin revolution occurring during subsequent sewing operations; and means for generating a signal when the number of thread revolutions remaining on said bobbin is sufficient to complete only one more seam of said predetermined length.

2. An apparatus according to claim 1 wherein said first means for counting comprises:

a first photodetector coupled adjacent said bobbin for generating a signal for each revolution of said bobbin; and a first counter having a plurality of outputs and having an input coupled to the output of said first photodetector for counting said signals.

3. An apparatus according to claim 2 wherein said second means for counting comprises:

a second photodetector coupled adjacent said bobbin during a bobbin winding operation for generating a signal for each revolution of said bobbin; and a second counter having a plurality of inputs and outputs and an additional input coupled to the output of said second photodetector for counting the signals generated by said second photodetector.

4. An apparatus according to claim 3 wherein said third means comprises a third counter having a plurality of outputs and having a plurality of inputs coupled to the plurality of outputs of said second counter for receiving therefrom the complement of a number contained in said second counter, said third counter having an additional input coupled to the output of said first photodetector for incrementing said third counter each time said first photodetector generates a signal.

5. An apparatus according to claim 4 wherein said first counter is a five bit binary counter.

6. An apparatus according to claim 5 wherein said second counter is an eleven bit binary counter.

7. An apparatus according to claim 6 further comprising:

means for generating a preset signal; and first means responsive to said preset signal for loading the complement of the contents of said five bit binary counter into said eleven bit binary counter.

8. An apparatus according to claim 7 wherein the complement of the contents of said five bit binary counter are loaded into the third through seventh most significant bits of said eleven bit counter.

9. An apparatus according to claim 7 wherein said third counter is an eleven bit binary counter.

10. An apparatus according to claim 7 further comprising second means responsive to said preset signal for loading the complement of the contents of said second counter into said third counter.

11. An apparatus according to claim 10 wherein said second responsive means includes a plurality of NOR gates each having a first input coupled to one of said plurality of outputs of said second counter, a second input coupled to said preset signal and an output coupled to one of said plurality of inputs of said third counter.

12. A method for determining when the length of thread remaining on a sewing machine bobbin in the form of a number of thread revolutions, each one of which corresponds to a bobbin revolution, is at least as long as a predetermined seam length, comprising:

monitoring the number of thread revolutions remaining on said bobbin, said monitoring comprising:

generating a signal for each bobbin revolution which occurs when sewing a seam of said predetermined length;

counting in a first counter the number of signals generated when sewing the seam;

transferring the complement of the contents of said first counter into a second counter;

winding a new bobbin;

generating a signal for each bobbin revolution during the winding step;

counting in said second counter the number of signals generated when winding a new bobbin;

transferring the complement of the contents of said second counter into a third counter; and incrementing said third counter for each revolution of said new bobbin which occurs during subsequent sewing operations; and generating a signal when the number of thread revolutions remaining is sufficient to complete only one more seam of said predetermined length.

13. A method for determining when the length of thread remaining on a sewing machine bobbin in the form of a number of thread revolutions, each one of which corresponds to a single bobbin revolution, is at least as long as a predetermined seam length comprising:

sewing a seam of said predetermined length;

counting in a first counter the number of bobbin revolutions which occur during said step of sewing;

loading the complement of the contents of said first counter into a second counter;

winding a new bobbin;

counting in said second counter the number of bobbin revolutions which occur during said winding;

loading the complement of a number contained in said second counter into a third counter;

counting in said third counter the number of bobbin revolutions which occur during subsequent sewing operations using said new bobbin;

detecting the maximum state of said third counter; and generating an alarm signal when said maximum state has been detected.

14. A pulse counting circuit, comprising:

first pulse counting means having an input and a plurality of outputs for counting a plurality of pulses applied to its input;

second pulse counting means for counting from a first number which is less than zero to a first more positive number, said second counting means having a pulse receiving input, a plurality of parallel inputs and a plurality of outputs;

first loading means coupled between said first counting means and said second counting means for loading the complement of the contents of said first counting means into said second counting means to form said first number;

third pulse counting means having a plurality of inputs, a plurality of outputs and an additional pulse receiving input for counting from a second number less than zero to a second more positive number; and second loading means coupled between said second counting means and said third counting means for loading the complement of the contents of said second counting means into said third counting means to form said second number.

15. A circuit according to claim 14 wherein said first counting means is a five bit binary counter.

16. A circuit according to claim 15 wherein said second means for counting is a first eleven bit binary counter.

17. A circuit according to claim 16 wherein said third counting means is a second eleven bit binary counter.

18. A circuit according to claim 17 wherein said first means for loading comprises a first plurality of logic gates each having an input coupled to a different one of the bits of said five bit counter and having an output coupled to a different one of the bits of said first eleven bit counter.

19. A circuit according to claim 18 wherein the first through fifth bits of said five bit binary counter are coupled via said first plurality of logic gates to the third through seventh bits of said first eleven bit counter respectively.

20. A circuit according to claim 19 wherein said second means for loading comprises a second plurality of logic gates each having an input coupled to a different one of the bits of said first eleven bit counter and an output coupled to a different one of the bits of said second eleven bit counter.

21. A circuit according to claim 20 wherein the third through eleventh bits of said first eleven bit counter are coupled to the third through eleventh bits of said second eleven bit counter respectively via said second plurality of logic gates.

22. A method for determining when a length of material wound on a housing in the form of a number of material revolutions, each corresponding to a housing revolution, is at least as long as a predetermined length, comprising:

monitoring the amount of material remaining on said housing, said monitoring comprising:

storing the number of housing revolutions corresponding to said predetermined length in a first counter;

loading the complement of the contents of said first counter into a second counter;

counting in said second counter the number of material revolutions on a full housing;

loading the complement of the contents of said second counter into a third counter;

counting in said third counter the number of housing revolutions which occur as the material is removed from said housing; and detecting a predetermined state of said third counter; and generating a signal when said predetermined state is detected to indicate that the length of material remaining on said housing is at least as long as said predetermined length.

* * * * *